United States Patent [19]

Mimura et al.

[11] 4,233,359

[45] Nov. 11, 1980

[54] LEATHERY SHEET MATERIAL AND PROCESS FOR THE PREPARATION THEREOF

[75] Inventors: Masahisa Mimura, Mihara; Isamu Nakano, Takehara; Nobuo Okawa, Mihara; Atsushi Tanaka, Fuchu, all of Japan

[73] Assignee: Teijin Limited, Osaka, Japan

[21] Appl. No.: 958,906

[22] Filed: Nov. 8, 1978 (Under 37 CFR 1.47)

[30] Foreign Application Priority Data

Nov. 8, 1977 [JP] Japan ..... 52-133084

[51] Int. Cl.[3] ..... B32B 27/40

[52] U.S. Cl. ..... 428/254; 427/245; 427/389.9; 428/264; 428/265; 428/267; 428/290; 428/423.5; 428/423.7; 428/425.1; 428/904

[58] Field of Search ..... 428/290, 425, 904, 254, 428/264, 265, 267; 427/245, 390 R

[56] References Cited

U.S. PATENT DOCUMENTS

| | | | |
|---|---|---|---|
| 3,985,929 | 10/1976 | von Bonin et al. | 428/904 X |
| 4,053,546 | 10/1977 | Yamasaki et al. | 428/425 X |
| 4,068,035 | 1/1978 | Violland et al. | 428/425 X |
| 4,092,286 | 5/1978 | Nou et al. | 428/425 X |

*Primary Examiner*—Marion McCamish

*Attorney, Agent, or Firm*—Sughrue, Rothwell, Mion, Zinn and Macpeak

[57] ABSTRACT

A leathery sheet material which comprises a fibrous mat and a polyurethane composition applied all over the mat in an amount of 10 to 80% by weight based on the total weight of the mat and the polyurethane composition. The polyurethane composition contains 0.1 to 5.0% by weight of a surface active agent having a molecular weight of 2,500 to 30,000 which comprises a hydrophilic component and a hydrophobic component being combined by a urethane bond and/or an amide bond. The hydrophilic component is polyethylene oxides comprising 30 to 80% by weight of the surface active agent and the hydrophobic component is a member selected from the group consisting of a polyalkylene oxides excepting polyethylene oxides, aliphatic polyesters and mixtures thereof. The leathery sheet material has excellent flexibility, excellent antistatic properties and excellent soil resistance.

11 Claims, No Drawings

LEATHERY SHEET MATERIAL AND PROCESS FOR THE PREPARATION THEREOF

BACKGROUND OF THE INVENTION

1. Field of the Invention

This invention relates to a leathery sheet material and to a process for the preparation thereof. More particularly, this invention is concerned with a leathery sheet material having excellent flexibility, antistatic properties and soil resistance which comprises a fibrous mat and a specific polyurethane composition applied all over the mat, and with a process for producing the same.

2. Description of the Prior Art

Heretofore, it has been known to produce artificial leathers consisting mainly of a non-woven, woven, or knitted fabric and a polyurethane composition as a substitute for natural leather. These artificial leathers, however, have the disadvantages: These artificial leathers tend to be charged with static electricity, and accordingly be contaminated with adsorbed dust; These artificial leathers do not have adequate flexibility suited for footwear and clothing uses.

In order to overcome the above-mentioned disadvantages of the prior arts, it has been proposed to produce artificial leathers by using a polyurethane composition containing a third component.

For example, Japanese Patent Application Publication No. 20522/77, Fukushima et al, published June 4, 1977, discloses a process for the preparation of artificial leathers using a polyurethane composition which contains as a third component a carboxylic acid, carboxylic acid ester, nitrile, amide, amine, sulfonic acid ester, ureido or urethane having an alkyl group of 4 to 50 carbon atoms. According to this process, a leathery sheet material having good flexibility is obtained, because the third component prevents the adhesion between fibers and polyurethane. As for the third components, there are exemplified stearic acid, sorbitanmonostearate, stearylonitrile, stearic acid amide, cetylamine, octadecane sulfonic acid methyl ester, stearic acid monoureido, ethyl cellulose and octadecyl urethane. However, the obtained leathery sheet material does not have antistatic properties when these compounds are used.

Japanese Patent Application Laid-Open No. 45654/77, Onoda et al, published Apr. 11, 1977, discloses a polyurethane composition containing a dicarboxylic acid ester so as to improve antistatic properties of the polyurethane. As for the dicarboxylic acid esters, there are exemplified compounds obtained by reacting itaconic acid, adipic acid or succinic acid with an adduct of actyl alcohol or lauryl alcohol and ethylene oxide. However, since the compounds are poor in compatibility with a polyurethane, they tend to bleed on the surface of artificial leathers in a long period and accordingly contaminate the articles. Further, the obtained artificial leathers are not endowed with durable antistatic properties.

SUMMARY OF THE INVENTION

It is one object of this invention to provide a leathery sheet material having excellent flexibility, outstanding antistatic properties and excellent soil resistance.

It is another object of this invention to provide a process for the preparation of the above leathery sheet material.

The abovementioned objects are attained by the leathery sheet material prepared in accordance with this invention, which comprises (1) a fibrous mat and (2) a polyurethane composition applied all over the fibrous mat in an amount of 10 to 80% by weight based on the total weight of the fibrous mat and the polyurethane composition, the polyurethane composition containing 0.1 to 5.0% by weight of a surface active agent based on the polyurethane composition, the surface active agent having a molecular weight of 2,500 to 30,000 and comprising 30 to 80% by weight of a hydrophilic component based on the surface active agent and a hydrophobic component, both the components being combined by a urethane bond and/or an amide bond, the hydrophilic component comprising polyethylene oxides and the hydrophobic component comprising a member selected from the group consisting of polyalkylene oxides excepting polyethylene oxides, aliphatic polyesters and mixtures thereof.

The surface active agent employed in this invention comprises a hydrophobic component and a hydrophilic component being combined by a urethane bond and/or an amide bond, and has a molecular weight of 2,500 to 30,000.

The hydrophobic component comprises a member selected from the group consisting of polyalkylene oxides excepting polyethylene oxides, aliphatic polyesters and mixtures thereof. Polyalkylene oxide as a hydrophobic component may contain not more than 20% by weight of polyethylene oxide chains in the molecule, provided polyalkylene oxide is substantially hydrophobic. As for polyalkylene oxides, there are preferably exemplified polypropylene ether glycol, polytetramethylene ether glycol, an adduct of bisphenol A and propylene oxide, an adduct of trimethylolpropane and propylene oxide, and an adduct of pentaerythritol and propylene oxide, each of which has a molecular weight of 1,500 to 6,000. These glycols may have one terminal blocked by alkoxy or phenylisocyanate group. The aliphatic polyesters may be obtained by reacting an aliphatic dicarboxylic acid with a glycol having a molecular weight of 1,000 or less. Aliphatic polyester as a hydrophobic component may contain not more than 20% by weight of aromatic or alicyclic ring in the molecule, which is substantially aliphatic polyester in this invention. As for aliphatic polyesters, there are preferably exemplified polyethylene adipate, polybutylene adipate and polyhexamethylene adipate, each of which has a molecular weight of 1,500 to 6,000. As for substantial aliphatic polyesters having aromatic ring, there is preferbly exemplified polybutyleneisophthalate-butylene adipate having a molecular weight of 1,500 to 6,000.

The hydrophilic component comprises polyethylene oxides, which may contain not more than 20% by weight of polypropylene oxide or polybutylene oxide chains in the molecule, provided the component is substantially hydrophilic. As for polyethylene oxides, there is preferably exemplified polyethylene glycol having a molecular weight of 800 to 9,000. The glycol may have one terminal blocked by alkoxy or phenylisocyanate group.

The surface active agent employed in this invention comprises the abovementioned hydrophobic and hydrophilic components being combined by a urethane bond and/or an amide bond. As for the mode of the urethane bond and/or the amide bond, there are exemplified as follows: (a) The bonds are formed by reacting a compound having at least one isocyanate group, which is obtained by reacting the hydrophilic component of polyethylene oxide with an organic diisocyanate, with the hydrophobic component of polyalkylene oxide or aliphatic polyester.

When a compound having one isocyanate group is employed for simplicity's sake, the abovementioned case is illustrated as shown in the following reaction formulas ($a_1$) and ($a_2$).

$$A_1-OCONH-X_1-NCO + HO-B_1 \longrightarrow A_1-OCONH-X_1-NHOCO-B_1 \quad (a_1)$$

$$A_1-OCONH-X_1-NCO + HOOC-C_1 \xrightarrow{-CO_2} A_1-OCONH-X_1-NHCO-C_1 \quad (a_2)$$

$A_1$ means a polyethylene oxide chain or a chain obtained by reacting polyethylene oxide with an organic diisocyanate. $X_1$ means the residue of organic diisocyanate, which may be also described as the residue of bond in this specification. $B_1$ and $C_1$ mean polyalkylene oxide and aliphatic polyester chains respectively.

In this invention, it is meant that the hydrophilic and hydrophobic components are combined by an urethane bond in the reaction formula ($a_1$). It is meant that the hydrophilic and hydrophobic components are combined by a urethane bond and an amide bond in the reaction formula ($a_2$).

(b) The bonds are formed by reacting a compound having at least one isocyanate group, which is obtained by reacting the hydrophobic component of polyalkylene oxide or aliphatic polyester with an organic diisocyanate, with the hydrophilic component of polyethylene oxide.

When a compound having one isocyanate group is employed for simplicity's sake, the abovementioned case is illustrated as shown in the following reaction formulas ($b_1$) and ($b_2$).

$$B_2-OCONH-X_1-NCO + HO-A_2 \longrightarrow B_2-OCONH-X_1-NHOCO-A_2 \quad (b_1)$$

$$C_2-CONH-X_1-NCO + HO-A_2 \longrightarrow C_2-CONH-X_1-NHOCO-A_2 \quad (b_2)$$

$A_2$ means a polyethylene oxide chain. $B_2$ means a polyalkylene oxide chain or a chain obtained by reacting polyalkylene oxide with an organic diisocyanate. $C_2$ means an aliphatic polyester chain or a chain obtained by reacting an aliphatic polyester with an organic diisocyanate.

In this invention, it is meant that the hydrophilic and hydrophobic components are combined by a urethane bond in the reaction formula ($b_1$). It is meant that the hydrophilic and hydrophobic components are combined by a urethane bond and an amide bond in the reaction formula ($b_2$).

(c) The bonds are formed by reacting a compound having at least one amino group, which is obtained by reacting the hydrophobic component of aliphatic polyester with an organic diamine, with chloroacetylpolyethylene oxide.

When a compound having one amino group is employed for simplicity's sake, the abovementioned case is illustrated as shown in the following reaction formula ($c_1$).

$$C_3\text{-}CONH\text{-}X_2\text{-}NH_2 + ClCH_2CO\text{-}A_3 \rightarrow C_3\text{-}CONH\text{-}X_2\text{-}NHCH_2CO\text{-}A_3 \ldots \quad (c_1)$$

$A_3$ means a polyethylene oxide chain. $C_3$ means an aliphatic polyester chain or a chain obtained by reacting an aliphatic polyester with an organic diamine. $X_2$ means the residue of organic diamine, which may be also described as the residue of bond in this specification.

In this invention, it is means that the hydrophilic and hydrophobic components are combined by an amido bond in the reaction formula ($c_1$).

As for the organic diisocyanates, there are exemplified hexamethylene diisocyanate, diphenylmethane-4,4'-diisocyanate, phenylene diisocyanate, tolylene-2,4-diisocyanate and dicyclohexylmethane-4,4'-diisocyanate. As for the organic diamines, there are exemplified ethylene diamine, propylene diamine, hexamethylene diamine and xylene diamine.

In the abovementioned (a) and (b), the reaction is conducted in a molten state or in a solution state using an organic solvent, such as dimethylformamide, dimethylacetamide and dimethyl sulfoxide. The reaction is conducted at a temperature of 40° to 80° C. for 60 to 180 minutes under normal pressure to obtain the surface active agent. In the reaction, it is possible to use a catalyst, such as triethylene diamine, triethylamine and dibutyl tin dilaurate. In the abovementioned (c), the reaction of chloroacetylpolyethylene oxide and an aliphatic polyester having at least one amino group is conducted at a temperature of 80° to 150° C. for 10 to 20 hours in an autoclave.

Chloroacetylpolyethylene oxide is obtained by reacting polyethylene oxide with chloroacetic acid at a temperature of 100° to 200° C. for 2 to 5 hours in an autoclave.

The surface active agent employed in this invention comprises 30 to 80% by weight of the hydrophilic components based on the surface active agent and 70 to 20% by weight of the total of the hydrophobic components, the urethane bonds and/or the amide bonds, and the residues of bonds. When the hydrophilic component is less than 30% by weight, the leathery sheet material obtained by using the polyurethane composition is insufficient in flexibility and antistatic properties. When the hydrophilic component is more than 80% by weight, the obtained surface active agent has too high hydrophilic properties and tends to bleed on the surface of the leathery sheet material in the wet condition, and hence is not used in this invention.

The molecular weight of the surface active agent is 2,500 to 30,000, preferably 3,500 to 25,000. When the molecular weight is less than 2,500, the obtained surface active agent has too low a melting point and tends to bleed on the surface of the leathery sheet material by heating or by being put in contact with an organic solvent, and hence is not used in this invention. When the molecular weight is more than 30,000, the obtained surface active agent has too high a melting point and tends to crystallize in the polyurethane composition and separate from the polyurethane composition, and hence is not used in this invention.

The polyurethane composition in this invention contains 0.1 to 5.0%, preferably 0.5 to 4.5% by weight of the surface active agent based on the polyurethane composition. When the amount is less than 0.1% by weight, the leathery sheet material obtained by using the polyurethane composition is insufficient in antistatic properties, soil resistance and flexibility. When the amount is more than 5.0% by weight, the surface active agent tends to bleed and the obtained leathery sheet material becomes poor in processability.

The polyurethane composition in this invention consists mainly of the surface active agent and a commercially obtainable polyurethane and also may contain therein polyvinyl acetate, polyvinyl chloride, polyacrylate, polyamide or polyester, provided the properties of polyurethane are undisturbed. These polymers may be usually used in an amount of not more than 20% by weight based on the polyurethane composition.

The polyurethane may be prepared by reacting a long chain diol, an organic diisocyanate and a low molecular weight chain extender in a molten, solution or slurry state. As for the long chain diols, there can be exemplified polyalkylene ether diols having a molecular weight of 1,000 to 4,000, such as polyethylene ether glycol, polypropylene ether glycol and polytetramethylene ether glycol; polyester diols having a molecular weight of 1,000 to 4,000, such as polyethylene adipate, polybutylene adipate and polyhexamethylene adipate. As for the organic diisocyanates, there can be exemplified diphenylmethane-4,4'-diisocyanate, tolylene-2,4-diisocyanate, xylylene diisocyanate, dicyclohexylmethane-4,4'-diisocyanate and hexamethylene diisocyanate. As for the low molecular weight chain extenders, there can be exemplified ethylene glycol, 1,4-butane diol, cyclohexane-1,4-diol, $\alpha,\alpha'$-p-xylene diol, 1,4-bis($\beta$-hydroxyethoxy)benzene, 2,2-bis[4-($\beta$-hydroxyethoxy)-phenyl]propane, propylene diamine and hexamethylene diamine.

The polyurethanes having a polyethylene oxide chain of 1 to 25% by weight in the molecule are preferably used in this invention, because they may increase the stabilities of the water-containing solution or slurry of the polyurethane compositions.

The low molecular weight chain extenders having alicyclic or aromatic rings in the molecule, such as cyclohexane-1,4-diol, $\alpha,\alpha'$-p-xylene diol, 1,4-bis($\beta$-hydroxyethoxy)benzene and 2,2-bis[4-($\beta$-hydroxyethoxy)phenyl]propane, are preferably used in this invention to obtain the polyurethanes having improved heat stabilities and resistance to microorganisms.

As for the organic solvents for the solution polymerization, there are dimethylformamide, dimethylacetamide and dimethyl sulfoxide.

The polyurethane slurry obtained by slurry polymerization, which contains particles of polyurethane dispersed in the organic solvent, is preferably used to form a microporous polyurethane film. The organic solvent to be used for the slurry polymerization can be selected in accordance with the compositions of the desired polyurethane in preparing a polyurethane slurry. In a dry method using a polyurethane slurry mentioned below, an organic solvent having a boiling point of not more than 120° C. and having a water solubility at 20° C. in the organic solvent of 1 to 50 g per 100 g of the organic solvent is preferably used to efficiently prepare a microporous polyurethane film. As solvents satisfying the above-criteria, there can be exemplified methyl ethyl ketone, diethyl ketone, methyl propyl ketone, methyl isobutyl ketone, ethyl formate, propyl formate, butyl formate, methyl acetate, ethyl acetate and a mixed solvent of not more than 50% by weight of tetrahydrofuran or dioxane and any of the abovementioned solvents.

The fibrous mat employed in this invention means a fabric, such as a non-woven, woven and knitted fabrics, formed from cotton, regenerated cellulose, nylon and polyester fibers. A non-woven fabric formed from nylon or polyester fibers, particularly highly shrinkable polyethylene terephthalate fibers is preferably used in this invention.

The preferred non-woven fabric can be produced according to the following steps:

forming a web having a weight of 5 to 40 g/m$^2$ from polyethylene terephthalate staples having a monofilament denier of 0.1 to 2.0, a length of 1.5 to 7.5 cm and a shrinkage percent of 30 to 55 in water at 70° C., by using a carding machine;

needlepunching a plurality of webs arranged in layers with a punching density of 200 to 2,000 punches/cm$^2$ by using a needle loom;

shrinking the needlepunched web 30 to 60% of its original area in water at 60° to 80° C.; and thereafter drying the shrunken web at 110° to 170° C. and at a pressure of 0.05 to 0.3 kg/cm$^2$ by using a belt press drying machine. Thus obtained non-woven fabrics may have a weight of 100 to 400 g/m$^2$, a thickness of 0.5 to 2 mm and an apparent density of 0.2 to 0.36 g/cm$^3$.

The leathery sheet material in this invention comprises the aforesaid fibrous mat and polyurethane composition applied all over the mat in an amount of 10 to 80%, preferably 35 to 65% by weight based on the total weight of the mat and polyurethane composition.

When the polyurethane composition is less than 10% by weight, the obtained leathery sheet material does not have sufficient strength for practical use. On the other hand, when the polyurethane composition is more than 80% by weight, the obtained leathery sheet material has too high elasticity and rubbery touch, and hence is not used in this invention.

The polyurethane composition is applied to the fibrous mat in the form of an organic solvent solution or slurry of the polyurethane composition.

When the polyurethane was obtained by molten polymerication, the obtained polyurethane can be dissolved in an organic solvent, such as dimethylformamide, dimethylacetamide and dimethyl sulfoxide, to form an organic solvent solution of the polyurethane. An organic solvent solution of the polyurethane composition of this invention is prepared by adding the surface active agent and, as the case may be, a polymer excepting polyurethane to the organic solvent solution of the polyurethane. It is preferable to prepare a solution having a concentration of polyurethane composition within a range of 5 to 30% by weight of the solution. As the case may be, the solution may contain therein a coloring agent, such as carbon black, pigments and dyestuffs, a thermal or light stabilizer, or an antioxidant. When water is mixed in the solution in an amount of 10 to 300%, preferably 50 to 200% by weight based on the polyurethane composition contained in the solution, a colloidal organic solvent solution of the polyurethane composition is formed, which solution is suitable for producing a microporous polyurethane film. The surface active agent in this invention has the effect of increasing the stability of the colloidal solution.

When the polyurethane was obtained by solution polymerization, the solution of polyurethane can be used as it is or after diluted with an organic solvent for preparing an organic solvent solution or colloidal organic solvent solution of the polyurethane composition by the same procedure as described above.

When the polyurethane was obtained by slurry polymerization, the slurry of polyurethane can be used as it is or after diluted with an organic solvent used in the polymerization for preparing an organic solvent slurry or colloidal organic solvent slurry of the polyurethane composition by the same procedure as described above. The surface active agent in this invention has the effect of greatly increasing the stability of the colloidal slurry.

For applying the organic solvent solution or slurry of the polyurethane composition to the fibrous mat, there may be adopted a method of impregnating the mat with the solution or slurry, a method of coating the surface of the mat with the solution or slurry, or a method of spraying the solution or slurry on the mat. The amount of the polyurethane composition (dry weight) applied to the fibrous mat must be 10 to 80%, preferably 35 to 65% by weight based on the total weight of the polyurethane composition and fibrous mat.

After the application, the polyurethane composition applied all over the fibrous mat is solidified or coagulated by a well-known dry or wet method to form a leathery sheet material in this invention. In this invention, in particular, an improved dry method is preferably used to efficiently obtain a microporous leathery sheet material, which method comprises immersing the fibrous mat treated with the solution or slurry of the polyurethane composition in water for a short period of time, e.g., 30 seconds to 5 minutes to remove a part of the organic solvent from the mat, and thereafter selectively evaporating the remaining organic solvent at 30° to 50° C. under a humid condition of 60 to 80% RH.

The leathery sheet material in this invention means thus obtained leathery sheet material, and also means a leathery sheet material having a porous layer thereon formed by coating a polyurethane composition by a knife coater on the surface of the leathery sheet material.

Since the hydrophobic component of the surface active agent in this invention is as same as or similar to a polyalkylene oxide and/or polyester chains in the polyurethane molecule, the surface active agent is compatible with the polyurethane. Further, a urethane and/or amide bond in the surface active agent forms intermolecular bonds (hydrogen bonds) with a urethane, amide or urea bond in the polyurethane molecule. Accordingly, the surface active agent in this invention mixed in the polyurethane is free from separating from the polyurethane even in a long period, and hence has excellent durability of antistatic properties. The surface active agent is also completely free from bleeding on the surface of the leathery sheet material and accordingly contaminating the articles. Further, since the hydrophilic component of the surface active agent in this invention is apt to adsorb water and the adsorbed water has an effect of preventing the adhesion between the fibrous mat and the polyurethane composition, the obtained leathery sheet material has excellent flexibility.

The leathery sheet material in this invention can be used as an artificial leather for making shoes, bags, clothing and so on as it is or after buffing the surface of the leathery sheet material or after forming a known surface finishing layer on the leathery sheet material by a gravure roller.

This invention is more specifically illustrated in the following examples. In the examples, parts are on a weight basis. The various physical properties mentioned in the examples were determined as follows:

1. Bending stiffness

A test piece having a length of 30 cm and a width of 2.5 cm was cut out from a leathery sheet material. The test piece was placed sticking out from a horizontal stand. The protruding length l (cm), the protruding angle $\theta$ (an angle formed between the extension of the horizontal plane of the stand and the line connecting the starting point of protrusion (the end of the horizontal stand) and the protruding end of the test piece), the weight W (g/cm$^2$) and the thickness h (cm) when applied a load of 500 g/cm$^2$ of the test piece were measured, and the bending stiffness was calculated from the following equation:

$$Rc = W \cdot l^3 \cdot \frac{\cos\frac{\theta}{2}}{8\tan\theta}\ (\mathrm{g \cdot cm})$$

$$\text{Bending stiffness} = \frac{12 \cdot Rc}{h^3}\ (\mathrm{kg/cm^2})$$

Smaller values show greater flexibility. A value of less than 90 means that it is almost near to the flexibility of natural leather.

2. Bleeding properties

A sheet material used for a measurement of bleeding properties was prepared from a leathery sheet material by coating a surface finishing paint on the surface of the leathery sheet material to a thickness of 15$\mu$ using a gravure roller and then drying at 150° C. for 10 minutes. The surface finishing paint consisted of a dimethylformamide solution containing 10% by weight of a polyurethane and carbonblack of 5% by weight based on the paint, which polyurethane was formed from polytetramethylene ether glycol having a molecular weight of 2,000, diphenylmethane-4,4'-diisocyanate and 1,4-butane diol.

(1) Bleeding property under a dry condition

Two test pieces each having a size of 5 cm×5 cm were cut out from the aforesaid sheet material. The two test pieces were laid one upon another with a surface of one test piece contacting the back surface of another piece, and then were placed between two glass plates and a load of 10 g/cm$^2$ was applied. The test pieces were heated at 40° C. for five weeks at 30% RH.

Thereupon, the surface (the finished surface) of the test piece contacted with the glass plate and the surface of another test piece contacted with the back surface of the test piece were observed, and bleeding was evaluated by the naked eye. Grading was shown by five levels as mentioned below.

(2) Bleeding property under a wet condition

Two test pieces each having a size of 5 cm×5 cm were cut out from the aforesaid sheet material. After leaving the test pieces for two days in a condition of 40° C. and 90% RH, the two test pieces were laid one upon another with a surface of one test piece contacting the back surface of another piece, and then were placed between two glass plates and a load of 10 g/cm$^2$ was applied. The test pieces were heated at 40° C. for five days at 50% RH. After repeating the aforesaid procedures alternately five times (thus making the total of five weeks), bleeding was evaluated by the same method as in the case of dry bleeding.

| | |
|---|---|
| 5 | bleeding scarcely occurred |
| 4 | bleeding slightly occurred |
| 3 | bleeding appreciably occurred |
| 2 | bleeding considerably occurred |
| 1 | bleeding greatly occurred |

The preferred value is 4 or more.

3. Antistatic properties

A test piece having a length of 12 cm and a width of 6 cm was cut out from a leathery sheet material. After leaving the test piece for 24 hours in a condition of 20° C. and 65% RH, the surface electric resistance of the test piece was measured at 20° C. and 65% RH using Measuring Machine of Electric Conductivity of Fibers (KOA SHOKAI CO.). The preferred value is not more than $1\times10^9\Omega$.

4. Resistance to bending

An artificial leather was bent 300,000 cycles in accordance with JIS-K-6545 (a method of bending test of leathers). The results were evaluated in accordance with JIS-K-6505, 5.2. Larger values show better resistance to bending.

5. Molecular weight

A molecular weight (a number average molecular weight) of a hydrophobic or hydrophilic component was calculated from the contents of hydroxyl or carboxyl end-groups in the component.

A molecular weight of a surface active agent was calculated from the molecular weights and the feeding ratio of hydrophobic component, hydrophilic component and combining component (an organic diisocyanate or an organic diamine) which were used for producing the surface active agent by using the following equation:

Molecular weight (MW) of a surface active agent=(MW of a hydrophobic component)×(repeating number of a hydrophobic component)+(MW of a combining component)×(repeating number of a combining component)+(MW of a hydrophilic component)×(repeating number of a hydrophilic component)

For example, where three components, hydrophobic, combining, and hydrophilic, are reacted in a molar ratio of 2:3:2, the repeating numbers of the hydrophobic, combining and hydrophilic components are 2, 3 and 2 respectively.

The calculated values were almost as same as the values measured by an osmotic pressure method.

EXAMPLES 1 to 4, Comparatives 1 and 2

[Preparation of a fibrous mat]

A web having a weight of 200 g/m$^2$ was formed from polyethylene terephthalate fibers (2.5 denier; 25 mm length) having a shrinkage percent of 45% in water at 70° C. by using a flat carding machine. This web was needlepunched with a punching density of 800 punches/cm$^2$ by using a needle loom, and then shrunken into 62% of its original area by immersing in water at 68° C. for 5 minutes. The shrunken web was dried at 130° C. and at a pressure of 0.10 kg/cm$^2$ by using a belt press drying machine to obtain a non-woven fabric (a fibrous mat) having a weight of 290 g/m$^2$, a thickness of 1.1 mm and an apparent density of 0.26 g/cm$^3$.

[Preparation of a surface active agent]

A mixture of 167 parts of polytetramethylene ether glycol (a molecular weight of 1,975), 31.9 parts of diphenylmethane-4,4'-diisocyanate and 0.02 part of triethylene diamine as a catalyst was reacted at 60° C. for 40 minutes. After adding 101 parts of polyethylene glycol (a molecular weight of 1,194) to the obtained reaction mixture, the mixture was reacted at 50° C. for 40 minutes, and then the excess isocyanate groups in the reaction product were blocked by uniformly admixing 0.06 part of dibutylamine to obtain a surface active agent of this invention. Thus obtained surface active agent had a molecular weight of 7,093 and contained 33.7% by weight of polyethyleneoxide chains.

[Preparation of a polyurethane slurry]

A mixture of 535 parts of polybutylene adipate (a molecular weight of 1,709), 311 parts of polytetramethylene ether glycol (a molecular weight of 1,493), 126 parts of 2,2-bis[4-(β-hydroxyethoxy)phenyl]propane, 670 parts of diphenylmethane-4,4'-diisocyanate, 0.05 part of triethylene diamine (catalyst) and 411 parts of methyl ethyl ketone (solvent) was reacted at 50° C. for 80 minutes in a reactor fitted with a stirrer to obtain a polyurethane pre-polymer. After adding 156 parts of 1,4-butane diol and 3.2 parts of triethylene diamine (catalyst) to the obtained pre-polymer, the mixture was reacted at 80° C. for 4 hours while gradually adding 6,789 parts of methyl ethyl ketone to obtain a polyurethane slurry.

Thus obtained polyurethane slurry contained 20% by weight of polyurethane and polyurethane particles each having a diameter of not more than 10μ.

[Preparation of a leathery sheet material]

An organic solvent slurry of polyurethane composition was prepared by admixing the aforesaid surface active agent in an amount as shown in Table 1 with the aforesaid polyurethane slurry containing 20% by weight of polyurethane. Thereafter, a water-containing organic solvent slurry of polyurethane composition was prepared by adding 25 parts of water per 100 parts of the slurry while stirring the slurry with a homomixer. The aforesaid non-woven fabric was immersed in the obtained slurry and then squeezed by nip rolls to a pick-up ratio of 440% based on the weight of the fabric to obtain the non-woven fabric impregnated with the slurry of 1,270 g/m$^2$. The aforesaid slurry was then coated on a surface of the impregnated non-woven fabric using a knife coater in an amount of 750 g/m$^2$. The coated non-woven fabric was immersed in water at 30° C. for 5 minutes to coagulate a part of polyurethane composition, and then dried at 40° C. for 30 minutes in a humid condition of 70% RH to evaporate methyl ethyl ketone, and further dried at 110° C. for 15 minutes to completely evaporate water. Thus obtained leathery sheet material had a weight of 615 g/m$^2$, a thickness of 1.4 mm and a polyurethane composition content of 41.2% by weight based on the total weight of the fabric and the polyurethane composition. The results of tests made on the physical properties of the obtained leathery sheet material were as shown in Table 1.

The leathery sheet materials obtained in accordance with this invention (Examples 1–4) had excellent flexibility (bending stiffness), antistatic properties, bleeding properties and resistance to bending. On the other hand, when the amount of a surface active agent contained in a polyurethane composition was less than 0.1% by weight (Comparative 1), the obtained leathery sheet material was poor in antistatic properties and flexibility.

When the amount of a surface active agent was more than 5.0% by weight (Comparative 2), the obtained leathery sheet material was poor in bleeding properties, and further had a disadvantage that the workability in the preparation of shoes and clothing was poor because of too high flexibility and too low tensile stress.

TABLE 1

| | Surface active agent content in the polyurethane composition (Wt %) | Physical properties of leathery sheet materials | | | | |
|---|---|---|---|---|---|---|
| | | Bending stiffness (kg/cm$^2$) | Dry bleeding (grade) | Wet bleeding (grade) | Surface electric resistance (Ω) | Resistance to bending (grade) |
| Comparative 1 | 0.05 | 142 | 5 | 5 | $9 \times 10^{10}$ | 3 |
| Example 1 | 0.15 | 88 | 5 | 5 | $9 \times 10^{8}$ | 4–5 |
| Example 2 | 0.5 | 77 | 5 | 5 | $1 \times 10^{8}$ | 5 |
| Example 3 | 2.5 | 57 | 5 | 5 | $8.5 \times 10^{7}$ | 5 |
| Example 4 | 4.5 | 46 | 4–5 | 4–5 | $6 \times 10^{7}$ | 5 |
| Comparative 2 | 5.5 | 40 | 3–4 | 3–4 | $5 \times 10^{7}$ | 5 |

EXAMPLES 5 to 7, Comparatives 3 and 4

[Preparation of a surface active agent]

A mixture of polytetramethylene ether glycol (a molecular weight of 1,975) and diphenylmethane-4,4'-diisocyanate in an amount as shown in Table 2 and 0.02 part of triethylene diamine as a catalyst was reacted at 60° C. for 40 minutes. After adding polyethylene glycol in an amount as shown in Table 2 to the obtained reaction mixture, the mixture was reacted at 50° C. for 40 minutes, and then the excess isocyanate groups in the reaction product were blocked by uniformly admixing 0.06 part of dibutylamine to obtain a surface active agent of this invention.

[Preparation of a leathery sheet material]

An organic solvent slurry of polyurethane composition was prepared by admixing the above obtained surface active agent with the polyurethane slurry containing 20% by weight of polyurethane as obtained in Example 1. The content of the surface active agent was 0.5% by weight based on the total weight of the polyurethane and the surface active agent. Thereafter, a leathery sheet material was prepared by the same procedure as in Example 1. The results of testing the physical properties of the obtained leathery sheet material were as shown in Table 2.

TABLE 2

| | Amount of polytetramethylene ether glycol used (parts) | Amount of diphenylmethane-4,4'-diisocyanate used (parts) | Amount of polyethylene glycol used (parts) (molecular weight) | Polyethylene oxide chain content in the surface active agent (Wt %) (molecular weight of the surface active agent) | Physical properties of leathery sheet materials | | | | |
|---|---|---|---|---|---|---|---|---|---|
| | | | | | Bending stiffness (kg/cm$^2$) | Dry bleeding (grade) | Wet bleeding (grade) | Surface electric resistance (Ω) | Resistance to bending (grade) |
| Comparative 3 | 208.0 | 39.8 | 64.2 (610) | 21.4 (5,691) | 115 | 5 | 5 | $7 \times 10^{9}$ | 4 |
| Example 5 | 152.1 | 29.1 | 118.8 (1,542) | 40.0 (7,789) | 50 | 5 | 5 | $7 \times 10^{7}$ | 5 |
| Example 6 | 108.4 | 20.7 | 170.8 (3,111) | 56.9 (10,927) | 55 | 5 | 5 | $6.9 \times 10^{7}$ | 5 |
| Example 7 | 69.1 | 13.2 | 217.7 (6,220) | 72.6 (17,150) | 58 | 5 | 5 | $6.5 \times 10^{7}$ | 5 |
| Comparative 4 | 33.6 | 6.4 | 260 (15,300) | 86.7 (35,305) | 108 | 5 | 3 | $6.5 \times 10^{7}$ | 4 |

The leathery sheet materials obtained in accordance with this invention (Examples 5–7) had excellent flexibility (bending stiffness), antistatic properties, bleeding properties and resistance to bending. On the other hand, when the hydrophilic component in a surface active agent was less than 30% by weight (Comparative 3), the obtained leathery sheet material was poor in flexibility and antistatic properties. When the hydrophilic component was more than 80% by weight (Comparative 4), the obtained leathery sheet material was outstandingly poor in wet bleeding.

EXAMPLE 8

[Preparation of a surface active agent]

A mixture of 115.8 parts of an adduct of bisphenol A and propylene oxide (a molecular weight of 2,231), 26.2 parts of dicyclohexylmethane-4,4'-diisocyanate and 0.02 part of triethylene diamine as a catalyst was reacted at 60° C. for 80 minutes. After adding 157.9 parts of polyethylene glycol (a molecular weight of 1,521) to the obtained reaction mixture, the mixture was reacted at 50° C. for 60 minutes to obtain a surface active agent in this invention. The obtained surface active agent had a molecular weight of 5,789 and the polyethylene oxide chain content of 52.6% by weight.

[Preparation of a leathery sheet material]

An organic solvent slurry of polyurethane composition was prepared by admixing the above obtained surface active agent with the polyurethane slurry containing 20% by weight of polyurethane as obtained in Example 1. The content of the surface active agent was 0.5% by weight based on the total weight of the polyurethane and the surface active agent. Thereafter, a leathery sheet material was prepared by the same procedure as in Example 1. The results of testing the physical properties of the obtained leathery sheet material were as shown in Table 3.

EXAMPLE 9

[Preparation of a surface active agent]

A mixture of 162.7 parts of an adduct of trimethylolpropane and propylene oxide (a molecular weight of 3,550), 23.2 parts of hexamethylene diisocyanate and 0.03 part of triethylene diamine as a catalyst was reacted at 80° C. for 60 minutes. After adding 114.1 parts of polyethylene glycol (a molecular weight of 830) to the obtained reaction mixture, the mixture was reacted at 50° C. for 60 minutes to obtain a surface active agent in this invention. The obtained surface active agent had a molecular weight of 6,544 and the polyethylene oxide chain content of 38.1% by weight.

[Preparation of a leathery sheet material]

An organic solvent slurry of polyurethane composition was prepared by admixing the above obtained surface active agent with the polyurethane slurry containing 20% by weight of polyurethane as obtained in Example 1. The content of the surface active agent was 2.5% by weight based on the total weight of the polyurethane and the surface active agent. Thereafter, a leathery sheet material was prepared by the same procedure as in Example 1. The results of testing the physical properties of the obtained leathery sheet material were as shown in Table 3.

EXAMPLE 10

[Preparation of a surface active agent]

A mixture of 495 parts of polyethylene adipate (a molecular weight of 1,980; having carboxyl groups in both terminals thereof) and 43.5 parts of hexamethylene diamine was heated at 150° C. for 30 minutes in an autoclave in a stream of nitrogen gas. After reducing the inner pressure of the autoclave to 1 mm Hg, the reaction was continued for 2 hours at 150° C. while removing a total of about 9 parts of water formed to obtain polyethylene adipate having an amino group in the terminal thereof.

A mixture of 760 parts of polyethylene oxide (a molecular weight of 1,520) and 47.25 parts of chloroacetic acid was reacted at 150° C. for 4 hours under a reduced pressure of 1 mm Hg in an autoclave while removing about 9 parts of water formed to obtain chloroacetylpolyethylene oxide.

A mixture of 431 parts of the above obtained polyethylene adipate having an amino group in the terminal thereof and 161.5 parts of chloroacetylpolyethylene oxide was reacted at 100° C. for 16 hours in an autoclave in a stream of nitrogen gas. The obtained surface active agent had a molecular weight of 7,536 and the polyethylene oxide chain content of 40.3% by weight.

[Preparation of a leathery sheet material]

A leathery sheet material was prepared using the above obtained surface active agent by the same procedure as in Example 9. The results of testing the physical properties of the obtained leathery sheet material were as shown in Table 3.

Comparative 5

A leathery sheet material was prepared by the same procedure as in Example 9, except that a known polypropyleneoxide-polyethyleneoxide block copolymer having a molecular weight of 2,712 (the molecular weights of polypropyleneoxide chain and polyethyleneoxide chain were 1,500 and 1,200 respectively, and the content of polyethyleneoxide chain was 44% by weight) was used as a surface active agent. The results of testing the physical properties of the obtained leathery sheet material were as shown in Table 3.

When the surface active agent not belonged to this invention was used, the obtained leathery sheet material was poor in bleeding properties, flexibility and resistance to bending.

EXAMPLE 11

[Preparation of a surface active agent]

A mixture of 123.4 parts of polyethylene glycol (a molecular weight of 3,111), 20 parts of diphenylmethane-4,4'-diisocyanate and 0.02 part of triethylene diamine as a catalyst was reacted at 50° C. for 40 minutes. After adding 156.6 parts of polypropylene ether glycol (a molecular weight of 1,975) to the obtained reaction mixture, the mixture was reacted at 60° C. for 60 minutes to obtain a surface active agent in this invention. The obtained surface active agent had a molecular weight of 7,561 and the content of polyethylene oxide chain of 41.1% by weight.

[Preparation of a polyurethane solution]

A mixtuure of 280 parts of polyethylene adipate (a molecular weight of 1,500), 177.5 parts of diphenylmethane-4,4'-diisocyanate, 20 parts of polyethylene glycol (a molecular weight of 1,502), 0.1 part of triethylene diamine (catalyst) and 119 parts of tetrahydrofuran (solvent) was reacted at 50° C. for 90 minutes in a reactor fitted with a stirrer to obtain a polyurethane prepolymer. After adding 45 parts of tetramethylene glycol and 1.0 part of triethylene diamine (catalyst) to the obtained pre-polymer, the mixture was reacted at 60° C. for 4 hours while gradually adding 1,970 parts of tetrahydrofuran to obtain a polyurethane solution containing 20% by weight of polyurethane. Thereafter, a polyurethane solution containing 15% by weight of polyurethane was obtained by adding 33.3 parts of methyl isobutyl ketone per 100 parts of the above obtained polyurethane solution.

[Preparation of a leathery sheet material]

An organic solvent solution of polyurethane composition was prepared by admixing the aforesaid surface active agent with the aforesaid polyurethane solution containing 15% by weight of polyurethane. The content of the surface active agent was 1.8% by weight based on the total weight of the polyurethane and the surface active agent. The non-woven fabric as obtained in Example 1 was immersed in thus obtained organic solvent solution of polyurethane composition and then squeezed by nip rolls to a pick-up ratio of 470% based on the weight of the fabric to obtain the non-woven fabric impregnated with the solution of 1,363 g/m$^2$. The impregnated fabric was immersed in water at 30° C. for 5 minutes to coagulate a part of polyurethane composition, and then dried at 30° C. for 30 minutes in a humid condition of 80% RH to evaporate the greater part of the solvent. Thereafter, the fabric was steamed at 110° C. to completely remove the solvent, and then dried at 110° C. for 10 minutes to completely evaporate water. Thus obtained leathery sheet material had a weight of 495 g/m$^2$, a thickness of 1.2 mm and a polyurethane composition content of 41.4% by weight based on the total weight of the fabric and the polyurethane composition. The results of testing the physical properties of the obtained leathery sheet material were as shown in Table 3.

EXAMPLE 12

[Preparation of a surface active agent]

A mixture of 78.9 parts of polybutylene-isophthalatebutylene adipate (a molecular weight of 2,310; the molar ratio of adipic acid to isophthalic acid was 80:20), 4.06 parts of phenylisocyanate (blocking agent of endgroups) and 0.001 part of dibutyl tin dilaurate (catalyst) was reacted at 60° C. for 60 minutes, and then reacted at 50° C. for 60 minutes after adding 8.5 parts of diphenylmethane-4,4'-diisocyanate. After adding 212.5 parts of polyethylene glycol (a molecular weight of 6,220) to the obtained reaction mixture, the mixture was reacted at 50° C. for 60 minutes to obtain a surface active agent of this invention. The obtained surface active agent had a molecular weight of 8,890 and the polyethylene oxide chain content of 70.8% by weight.

[Preparation of a polyurethane solution]

A mixture of 723 parts of polybutylene adipate (a molecular weight of 1,730), 162 parts of polytetramethylene ether glycol (a molecular weight of 1,550), 156 parts of 2,2-bis[4-(β-hydroxyethoxy)phenyl]propane, 735 parts of diphenylmethane-4,4'-diisocyanate, 0.05 part of triethylene diamine (catalyst) and 444 parts of dimethylformamide (solvent) was reacted at 45° C. for 80 minutes in a reactor fitted with a stirrer to obtain a polyurethane pre-polymer. After adding 171 parts of 1,4-butane diol and 1.0 part of triethylene diamine (catalyst) to the obtained pre-polymer, the mixture was reacted at 75° C. for 3 hours while gradually adding 7,344 parts of dimethylformamide to obtain a polyurethane solution containing 20% by weight of polyurethane. Thereafter, a polyurethane solution containing 15% by weight of polyurethane was obtained by adding 33.3 parts of methyl ethyl ketone per 100 parts of the above obtained polyurethane solution.

[Preparation of a leathery sheet material]

An organic solvent solution of polyurethane composition was prepared by admixing the aforesaid surface active agent with the aforesaid polyurethane solution containing 15% by weight of polyurethane. The content of the surface active agent was 4.0% by weight based on the total weight of the polyurethane and the surface active agent. A water-containing organic solvent solution of polyurethane composition was prepared by adding 25 parts of water per 100 parts of the solution while stirring the solution with a homomixer. The non-woven fabric as obtained in Example 1 was immersed in the obtained solution and then squeezed by nip rolls to a pick-up ratio of 470% based on the weight of the fabric to obtain the non-woven fabric impregnated with the solution of 1,360 g/m$^2$. The aforesaid solution was then coated on a surface of the impregnated non-woven fabric using a knife coater in an amount of 700 g/m$^2$. The coated non-woven fabric was immersed in water at 30° C. for 30 minutes to coagulate the polyurethane composition and washed with water to remove the remaining solvent, and then dried at 110° C. for 10 minutes. Thus obtained leathery sheet material had a weight of 600 g/m$^2$, a thickness of 1.4 mm and a polyurethane composition content of 41.4% by weight based on the total weight of the fabric and the polyurethane composition. The results of testing the physical properties of the obtained leathery sheet material were as shown in Table 3.

TABLE 3

| | Surface active agent content in the polyurethane composition (Wt %) | Physical properties of leathery sheet materials | | | | |
|---|---|---|---|---|---|---|
| | | Bending stiffness (kg/cm$^2$) | Dry bleeding (grade) | Wet bleeding (grade) | Surface electric resistance (Ω) | Resistance to bending (grade) |
| Example 8 | 0.5 | 56 | 5 | 5 | $6.5 \times 10^7$ | 5 |
| Example 9 | 2.5 | 45 | 5 | 5 | $3 \times 10^7$ | 5 |
| Example 10 | 2.5 | 65 | 5 | 5 | $7 \times 10^7$ | 5 |
| Comparative 5 | 2.5 | 168 | 3 | 3 | $9 \times 10^7$ | 3 |
| Example 11 | 1.8 | 85 | 5 | 5 | $5 \times 10^7$ | 5 |
| Example 12 | 4.0 | 45 | 5 | 5 | $1.5 \times 10^7$ | 5 |

What is claimed is:

1. A leathery sheet material having excellent flexibility, antistatic properties and soil resistance which comprises (1) a fibrous mat and (2) a polyurethane composition applied all over said mat in an amount of 10 to 80% by weight based on the total weight of said mat and said polyurethane composition, said polyurethane composition containing 0.1 to 5.0% by weight of a surface active agent based on said polyurethane composition, said surface active agent having a molecular weight of 2,500 to 30,000 and comprising 30 to 80% by weight of a hydrophilic component based on said surface active agent and a hydrophobic component, both the components being combined by a urethane bond and/or an amide bond, said hydrophilic component comprising polyethylene oxides and said hydrophobic component comprising a member selected from the group consisting of (a) polyalkylene oxides excepting polyethylene oxides, (b) aliphatic polyesters and (c) mixtures thereof.

2. The leathery sheet material according to claim 1, wherein the surface active agent is a reaction product obtained by reacting (1) a compound having at least one isocyanate group which is obtained by reacting a hydrophilic component comprising polyethylene oxides with an organic diisocyanate, with (2) a hydrophobic component comprising a member selected from the group consisting of (a) polyalkylene oxides excepting polyethylene oxides, (b) aliphatic polyesters and (c) mixtures thereof.

3. The leathery sheet material according to claim 1, wherein the surface active agent is a reaction product obtained by reacting (1) a compound having at least one isocyanate group which is obtained by reacting a hydrophobic component comprising a member selected from the group consisting of (a) polyalkylene oxides excepting polyethylene oxides, (b) aliphatic polyesters and (c) mixtures thereof with an organic diisocyanate, with (2) a hydrophilic component comprising polyethylene oxides.

4. The leathery sheet material according to claim 1, 2 or 3, wherein the polyethylene oxide is polyethylene glycol having a molecular weight of 800 to 9,000.

5. The leathery sheet material according to claim 1, 2 or 3, wherein the polyalkylene oxide is a member selected from the group consisting of polypropylene ether glycol, polytetramethylene ether glycol, an adduct of bisphenol A and propylene oxide, and an adduct of trimethylolpropane and propylene oxide, each of which has a molecular weight of 1,500 to 6,000.

6. The leathery sheet material according to claim 1, 2 or 3, wherein the aliphatic polyester is a member selected from the group consisting of polyethylene adipate, polybutylene adipate, polyhexamethylene adipate and polybutylene-isophthalate-butylene adipate, each of which has a molecular weight of 1,500 to 6,000.

7. The leathery sheet material according to claim 2 or 3, wherein the organic diisocyanate is a member selected from the group consisting of hexamethylene diisocyanate, diphenylmethane-4,4'-diisocyanate and dicyclohexylmethane-4,4'-diisocyanate.

8. A process for the preparation of leathery sheet materials having excellent flexibility, antistatic properties and soil resistance which comprises the steps of:

(1) preparing an organic solvent solution or slurry containing 5 to 30% by weight of a polyurethane composition based on said organic solvent solution or slurry, said polyurethane composition containing 0.1 to 5.0% by weight of a surface active agent based on said polyurethane composition, said surface active agent having a molecular weight of 2,500 to 30,000 and comprising 30 to 80% by weight of a hydrophilic component based on said surface active agent and a hydrophobic component, both the components being combined by a urethane bond and/or an amide bond, said hydrophilic component comprising polyethylene oxides and said hydrophobic component comprising a member selected from the group consisting of (a) polyalkylene oxides excepting polyethylene oxides, (b) aliphatic polyesters and (c) mixtures thereof;

(2) applying to a fibrous mat the organic solvent solution or slurry of the polyurethane composition, in a dry amount of 10 to 80% by weight of the polyurethane composition based on the total weight of said mat and said polyurethane composition; and (3) removing the organic solvent from the fibrous mat to solidify the polyurethane composition in the fibrous mat.

9. The process according to claim 8, wherein the organic solvent solution or slurry of the polyurethane composition contains 10 to 300% by weight of water based on the polyurethane composition contained in the organic solvent solution or slurry.

10. The process according to claim 8, wherein the organic solvent is an organic solvent having a boiling point of 120° C. or less, and having a water solubility at 20° C. in the organic solvent of 1 to 50 g per 100 g of the organic solvent used.

11. The process according to claim 8, wherein the fibrous mat treated with the organic solvent solution or slurry of the polyurethane composition is immersed in water for a short period to remove a part of the organic solvent, and thereafter the fibrous mat is heated in a humid atmosphere to selectively evaporate the remaining organic solvent.

* * * * *